US005451148A

United States Patent [19]

Matsuzaki et al.

[11] Patent Number: 5,451,148

[45] Date of Patent: Sep. 19, 1995

[54] CHECK VALVE DEVICE FOR SCROLL COMPRESSOR

[75] Inventors: Ryoichi Matsuzaki, Shiga; Takeshi Hashimoto, Kyoto; Shigeru Muramatsu, Kusatsu; Toshiharu Yasu, Shiga; Hiroyuki Masunaga, Kusatsu, all of Japan

[73] Assignee: Matsushita Electric Industrial Co., Ltd., Osaka, Japan

[21] Appl. No.: 271,054

[22] Filed: Jul. 8, 1994

[30] Foreign Application Priority Data

Jul. 9, 1993 [JP] Japan ..... 5-170115
Jul. 9, 1993 [JP] Japan ..... 5-170116

[51] Int. Cl.[6] ..... F04C 18/04; F04C 29/02

[52] U.S. Cl. ..... 418/55.1; 418/55.6; 418/270; 137/543.21

[58] Field of Search ..... 418/55.1, 55.6, 270; 137/543.21

[56] References Cited

U.S. PATENT DOCUMENTS 4,865,136 9/1989 White ..... 137/543.21

FOREIGN PATENT DOCUMENTS 56-28237 6/1981 Japan .
1-34312 7/1989 Japan .
3271585 12/1991 Japan ..... 418/55.1
5157067 6/1993 Japan ..... 418/55.1

*Primary Examiner*—John J. Vrablik
*Attorney, Agent, or Firm*—Wenderoth, Lind & Ponack

[57] ABSTRACT

A check valve device is provided for a scroll compressor in which a crescent-shaped compression chamber is defined by a fixed scroll and an orbiting scroll, the orbiting scroll being driven to compress gas introduced into the compression chamber such that the compressed gas is discharged out of a discharge port provided in the vicinity of a center of the fixed scroll. The check valve device includes a check valve having a disk for closing the discharge port, a ring concentric with the disk and a plurality of beams coupling the disk and the ring, a tube receiving the check valve and which is provided at the discharge port of the fixed scroll, and a valve retainer for retaining the check valve. The valve retainer is provided at an outlet portion of the tube so as to confront the ring of the check valve.

9 Claims, 13 Drawing Sheets

CHECK VALVE DEVICE FOR SCROLL COMPRESSOR

BACKGROUND OF THE INVENTION

The present invention relates to a check valve of a scroll compressor used for refrigeration and air conditioning.

The operating principle of a scroll compressor is known from, for example, U.S. Pat. No. 801,182.

FIGS. 3A to 3D illustrate the basic principle behind the known scroll compressor. A crescent-shaped compression chamber 11 is defined by a fixed scroll 1 and an orbiting scroll 2. When the orbiting scroll 2 undergoes its orbiting motion, the volume of the compression chamber 11 gradually decreases as shown from FIG. 3A to FIG. 3C. In the state shown in FIG. 3C, the compression chamber 11 communicates with a discharge port 22 provided at a central portion of the fixed scroll 1. In the process illustrated from FIG. 3C to FIG. 3D, compressed refrigerant is discharged. In the known scroll compressor in which the refrigerant is compressed, it is possible to prevent the refrigerant from leaking from the compression chamber 11. Meanwhile, the known scroll compressor does not require a delivery valve in contrast with a reciprocating compressor and a rolling piston type of compressor and thus, is less noisy than such compressors.

However, in the known scroll compressor having no delivery valve, the orbiting scroll 2 is urged in reverse at a high speed due to a rapid back-flow of the refrigerant from a high-pressure side to a low-pressure side when the scroll compressor is stopped, such that abnormal noises and damage to its components may be incurred. In order to eliminate such potential problems, a device for preventing reverse movement of the orbiting scroll 2 must be provided.

Devices for preventing reverse movement of the orbiting scroll 2 are disclosed in, for example, Japanese Patent Publication Nos. 56-28237 (1981) and 1-34312 (1989). These devices are shown in FIGS. 9 and 10, respectively. In the former prior art device, a delivery valve 58 acting as a check valve is provided over a discharge port 22 located at a central portion of a fixed scroll 1 so as to prevent back-flow of refrigerant from a discharge space to a compression chamber when the compressor is stopped. This prior art document mentions that loss at the time of discharge can be prevented by this arrangement. However, in this arrangement, since the delivery valve 58 closes at the end of each rotation of a driving shaft 6, noises due to the striking of a valve seat by the closing delivery valve 58 are produced.

Meanwhile, in the latter prior art device, a valve 59 acting as a check valve and supported by a spring 26 is fixed to one end of a suction port 25 provided at the periphery of a fixed scroll 1 so as to prevent a back-flow of refrigerant. This prior art document acknowledges that the flow of oil out of a compressor can be prevented when the compressor is stopped. However, since the check valve is provided at the suction side, i.e., a low-pressure side, a back-flow of the refrigerant in an amount corresponding to the volume of space between the check valve and a discharge port takes place and thus, reverse movement of the orbiting scroll due to a back-flow of the refrigerant cannot be prevented completely. Furthermore, this check valve has a complicated structure.

Therefore, there is a demand for a check valve having a simple structure, and which not only positively prevents reverse movement of a orbiting scroll due to back-flow of refrigerant but also produces little noise.

To this end, a check valve shown in FIG. 4 was previously proposed by the present inventors and was placed on the market. In this device, a tube 23 for receiving a check valve 4 is provided on a discharge port 22 of a fixed scroll 1, and a valve retainer 5 for preventing the check valve 4 from being detached from the tube 23 is mounted on the tube 23. FIG. 11 shows the check valve 4. As shown in FIG. 11, the check valve 4 has the shape of a cross in which a plurality of legs 45 protrude from an outer periphery of a disk 41. In this conventional check valve device, since the check valve 4 is pressed against the valve retainer 5 by refrigerant, noises due to a striking of a valve seat by a check valve as in a delivery valve are not produced. However, rotation or chattering of the check valve 4 due to flowing refrigerant occurs according to various operational conditions, thus resulting in the production of noise. In particular, when the compression ratio, which is a ratio of high pressure to low pressure, rises, the refrigerant flows reversely in the vicinity of the check valve 4, thereby causing the check valve 4 to chatter.

SUMMARY OF THE INVENTION

Accordingly, an essential object of the present invention is to eliminate the disadvantages inherent in conventional check valve devices by providing a check valve device for a scroll compressor, which produces little noise over a wide range of operational conditions.

A check valve device for a scroll compressor, according to the present invention comprises: a check valve which includes a disk for closing a discharge port of a fixed scroll, a ring disposed radially outwardly of the disk and a plurality of beams for coupling the disk and the ring; a tube for receiving the check valve, which is provided at the discharge port; and a valve retainer for retaining the check valve, which is provided at an outlet portion of the tube so as to confront the ring of the check valve.

Furthermore, the check valve and the valve retainer contact each other, a combined surface roughness of the check valve device is less than a thickness of 5 $\mu$m of an oil film.

In accordance with the present invention, the check valve is formed with the ring. Therefore, when the check valve is depressed against the valve retainer, the ring is brought into contact with the valve retainer through the oil film, etc. When the combined surface roughness of the check valve device is less than the thickness of the oil film, the oil film produces a large adhesion force at contacting portions of the check valve and the valve retainer. By this effect, chattering of the check valve due to the flow of refrigerant or counter pressure can be prevented.

BRIEF DESCRIPTION OF THE DRAWINGS

This object and features of the present invention will become more apparent from the following description of the preferred embodiment of the invention made with reference to the accompanying drawings, in which.

Before the description of the present invention proceeds, it is to be noted that like parts are designated by like reference numerals through the accompanying drawings.

DETAILED DESCRIPTION OF THE INVENTION

Figure 1:
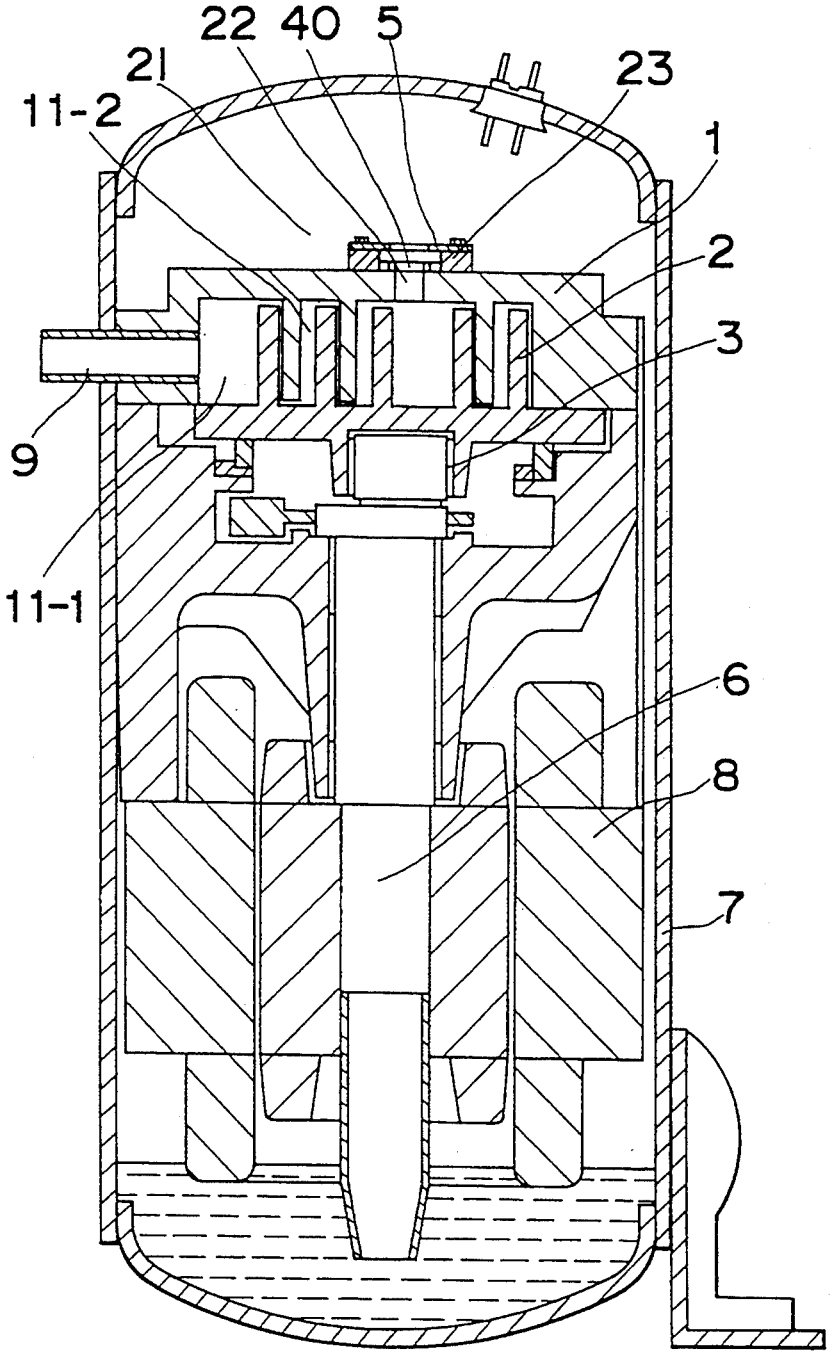
FIG. 1 is a longitudinal sectional view of a scroll compressor including a check valve device according to the present invention.

Referring now to FIG. 1, a scroll compressor according to one embodiment of the present invention includes a fixed scroll 1 and an orbiting scroll 2 provided in a closed vessel 7. The orbiting scroll 2 is driven by a motor 8 through a driving shaft 6 and an eccentric bearing 3. Refrigerant gas aspirated through a suction tube 9 is gradually compressed in crescent-shaped compression chambers 11-1 and 11-2 defined by the fixed scroll 1 and the orbiting scroll 2 so as to be discharged into a discharge space 21 through a discharge port 22 provided at a central portion of the fixed scroll 1.

A check valve 40 is accommodated in a tube 23 provided at an outlet of the discharge port 22. At an outlet portion of the tube 23, a valve retainer 5 is secured to the fixed scroll 1 together with the tube 23 by screws.

Figure 2:
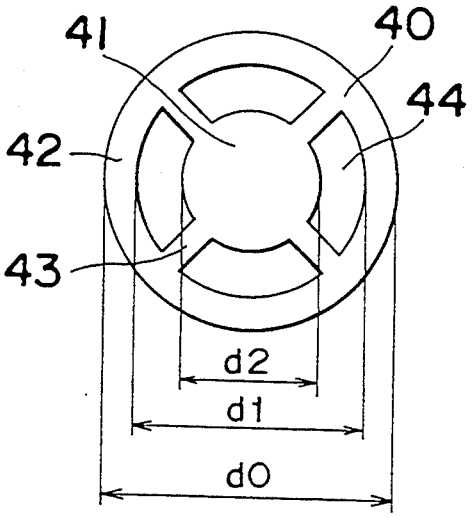
FIG. 2 is a plan view of a check valve employed in the check valve device of FIG. 1.
Figure 3A:
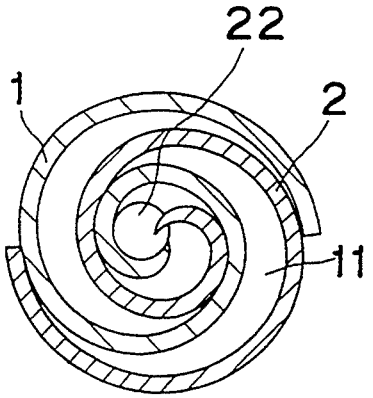
Fig. 3A PRIOR ART
FIGS. 3A to 3D illustrate compression in a prior art scroll compressor.
Figure 3B:
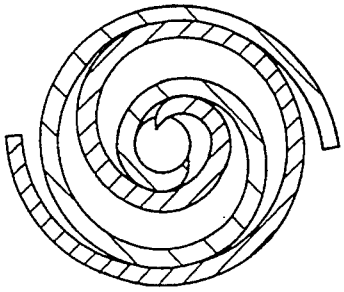
Fig. 3B PRIOR ART
Figure 3C:
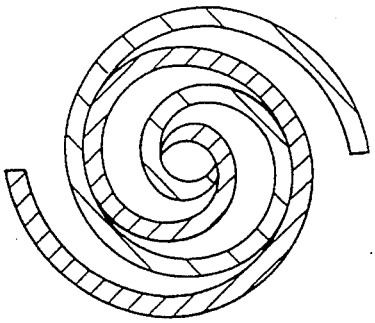
Fig. 3C PRIOR ART
Figure 3D:
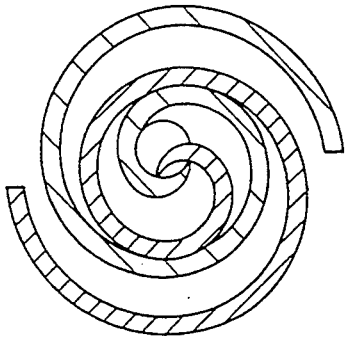
Fig. 3D PRIOR ART
Figure 5:
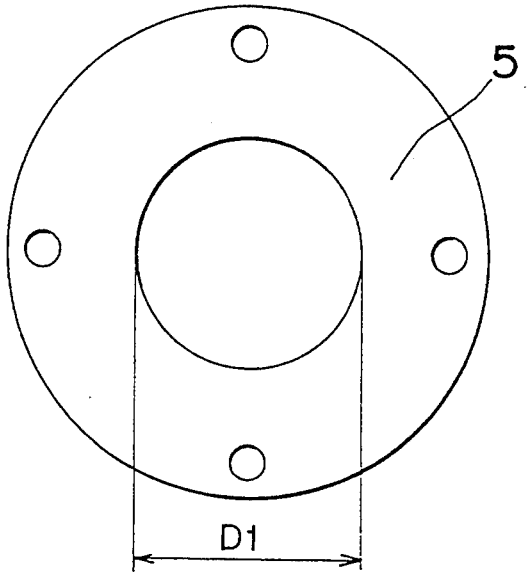
FIG. 5 is a plan view of a valve retainer employed in the check valve device of FIG. 1.
Figure 6A:
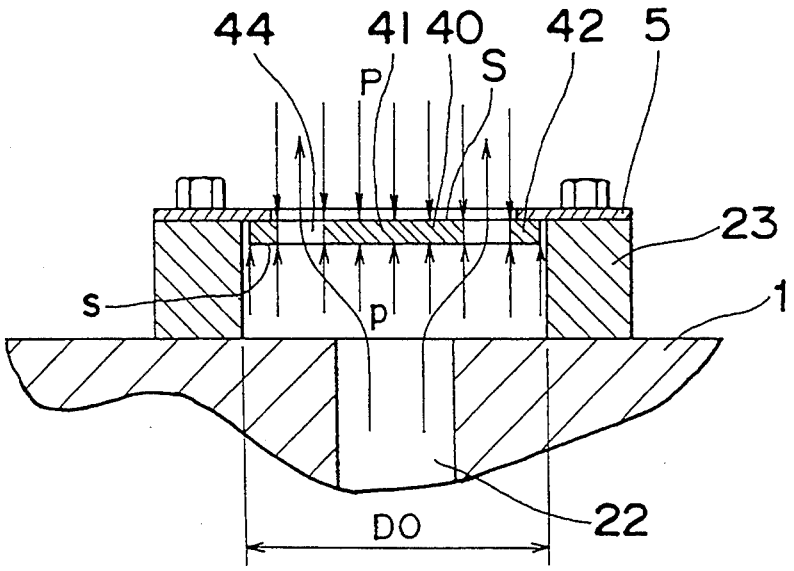
FIGS. 6A and 6B are fragmentary longitudinal sectional views of the check valve device of FIG. 1 during operation and while the scroll compressor is stopped, respectively.
Figure 8:
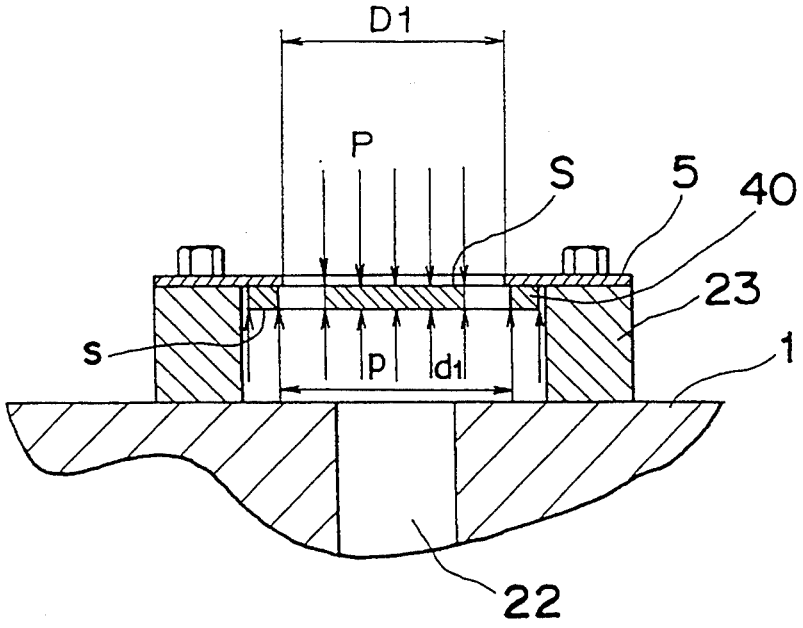
FIG. 8 is a view similar to FIGS. 6A and 6B, but showing a modified form of the check valve device.
Figure 9:
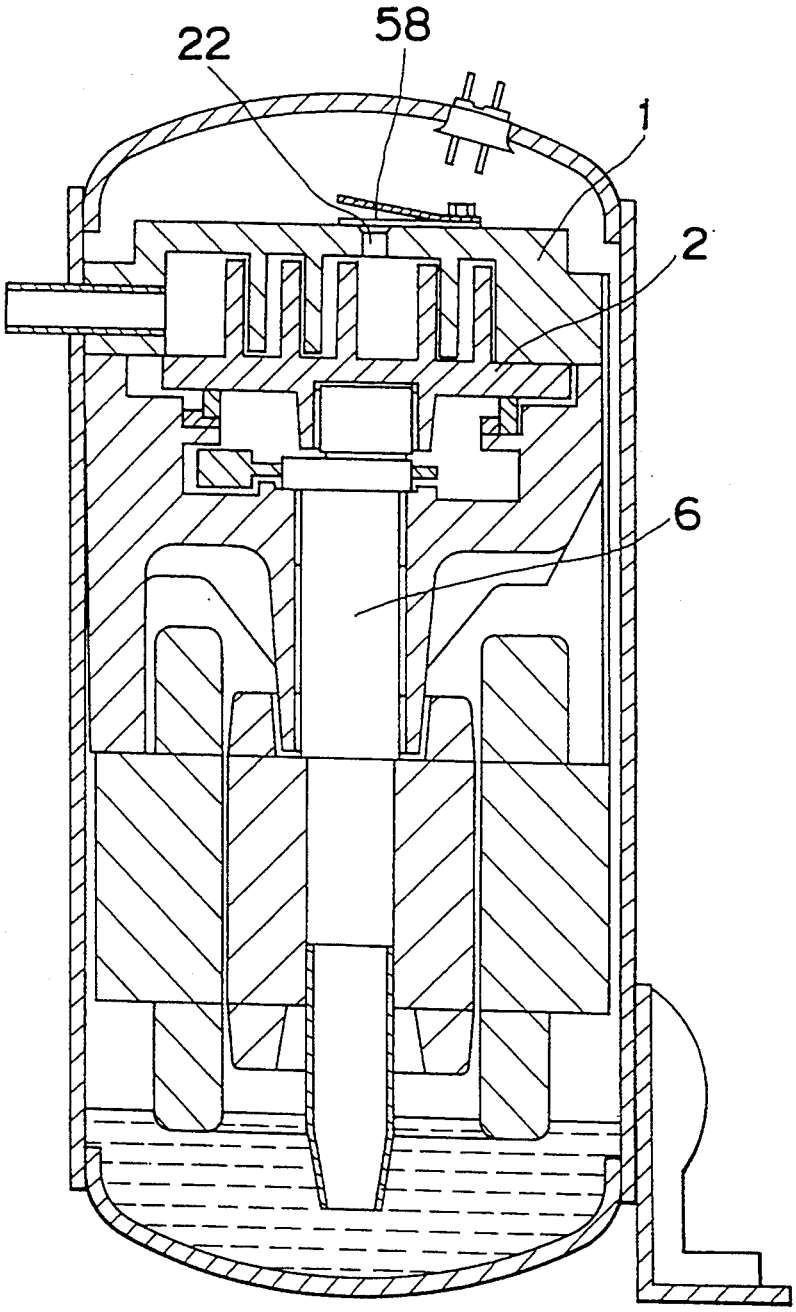
Fig. 9 PRIOR ART
FIG. 9 is a longitudinal sectional view of another known scroll compressor.
Figure 10:
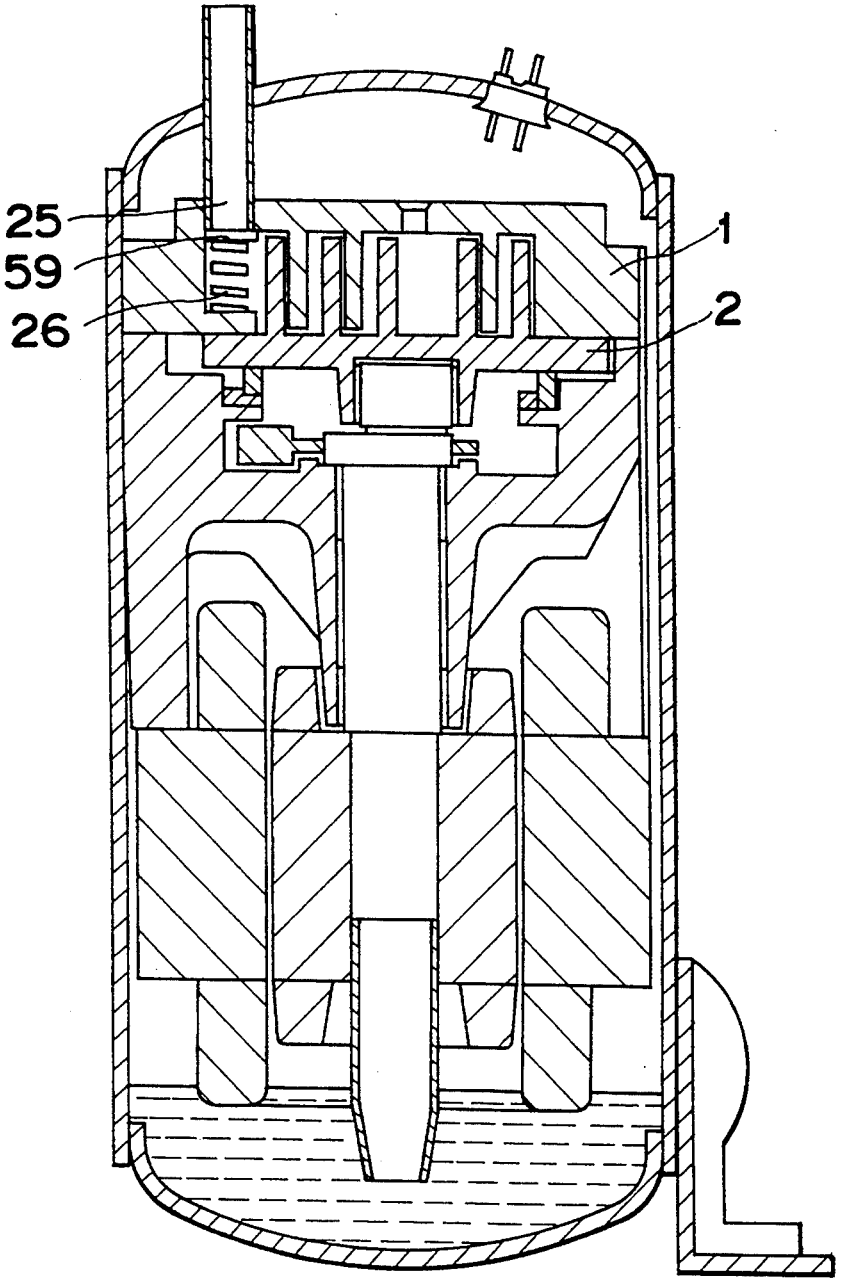
Fig. 10 PRIOR ART
FIG. 10 is a longitudinal sectional view of still another known scroll compressor.

FIG. 2 shows one example of the check valve 40, while FIG. 5 shows one example of the valve retainer 5. As shown in FIG. 2, the check valve 40 includes a disk 41 for closing the discharge port 22 of the fixed scroll 1, a ring 42 provided outside the disk 41 and having an inside diameter d1 and an outside diameter d0, and several beams 43 coupling the disk 41 and the ring 42. Vacant portions of the check valve 40 are used as flow paths 44 for refrigerant. As shown in FIG. 2, the beams 43 spaced from each other in the circumferential direction of disk 41, and each of the beams has opposite linear sides extending in directions parallel to radial directions of the disk 41. Accordingly, each of the flow paths 44 is delimited by an arcuate inner peripheral surface of ring 42, an arcuate outer peripheral surface of disk 41, cd respective linear sides of adjacent ones of the beams 43. To ensure a sufficient area of the flow paths 44, the beams 43 are spaced from each other by distances respectively greater than each of the widths of the beams 43. As shown in FIG. 6A, the tube 23 for receiving the check valve 40 has an inside diameter D0. As shown in FIG. 8, a bore having a diameter D1 approximately the same as the inside diameter d1 of the ring 42 of the check valve 40 is formed at the center of the valve retainer 5.

Figure 6B:
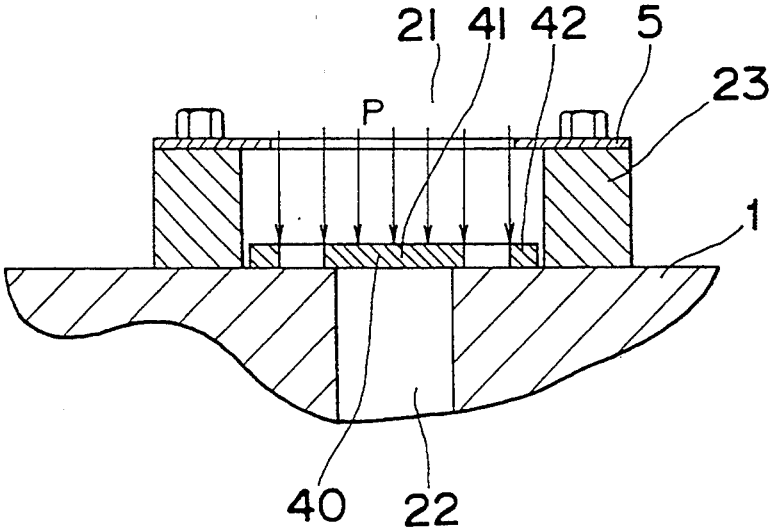

The fundamental operation of the check valve device is described hereinbelow. FIG. 6A shows a state of the check valve 40 during operation of the scroll compressor. At this time, the check valve 40 is depressed against the valve retainer 5 by pressure of refrigerant to be discharged and the refrigerant passes through the flow paths 44 defined between the disk 41 and the ring 42 of the check valve 40. On the other hand, FIG. 6B shows the state of the check valve 40 when the scroll compressor is stopped. At this time, since the pressure of the refrigerant to be discharged has been relieved, the check valve 40 is pushed back by pressure of refrigerant in the discharge space 21, so that the discharge port 22 is closed by the disk 41 of the check valve 40 and thus, a backflow of the refrigerant is prevented.

Figure 4:
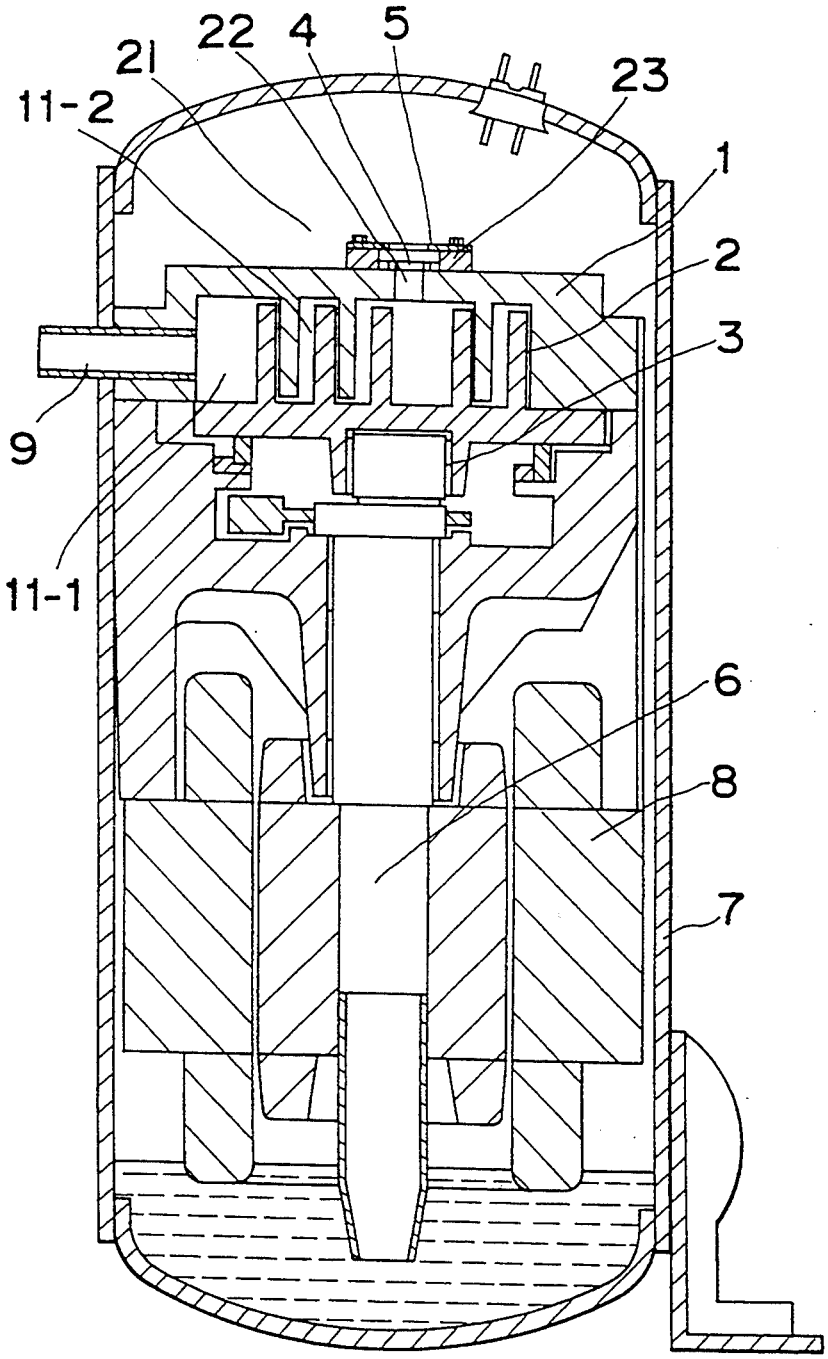
Fig. 4 PRIOR ART
FIG. 4 is a longitudinal sectional view of the prior art scroll compressor of FIGS. 3A to 3D.
Figure 11:
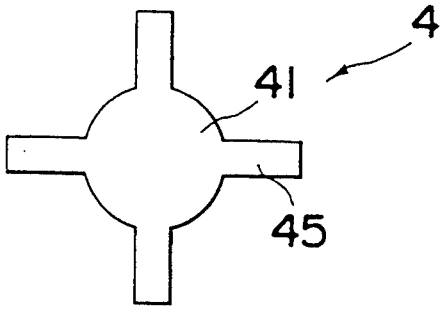
Fig. 11 PRIOR ART
FIG. 11 is a plan view of a check valve employed in a check valve device of the prior art scroll compressor of FIG. 4.

In order to further describe the advantage of the present invention, the operation of the check valve 40 of the present invention will now be compared with that of the prior art check valve 4 of FIG. 4 having the shape of a cross. In the prior art check valve 4 of FIG. 11, an area of contact between the check valve and the valve retainer 5 when the check valve 4 is depressed against the valve retainer 5 is restricted to a narrow distal end portion of each of the legs 45 of the check valve 4.

Figure 7:
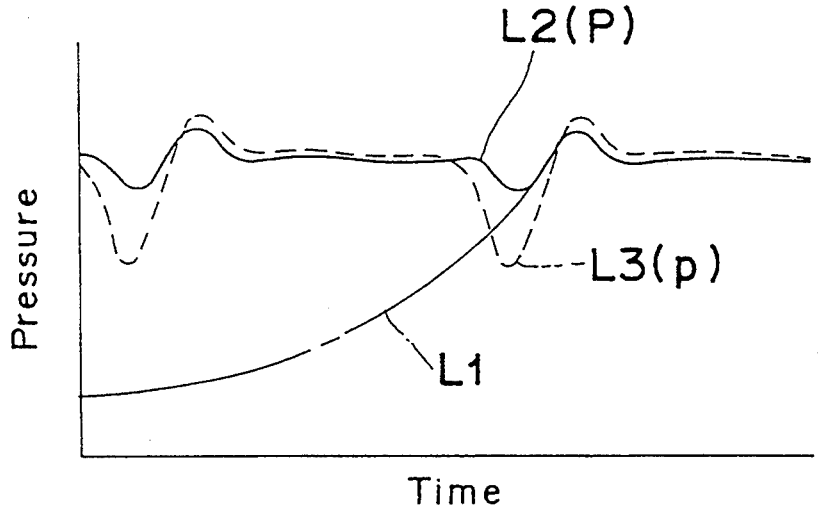
FIG. 7 is a graph of changes in pressure in the scroll compressor of FIG. 1 with time.

The force applied to the check valve 40 is described in detail with reference to FIG. 7 in which the one-dot chain line L1 represents pressure of refrigerant in chamber 11-1 or 11-2, the solid line L2 represents pressure P in the discharge space 21 and the broken line L3 represents pressure p in the discharge port 22. During operation, the check valve 40 is usually pushed towards the valve retainer 5 by the pressure in the discharge port 22. Meanwhile, a scroll compressor generally has a constant compression volume ratio which is a ratio of the suction volume to discharge volume. When an overload occurs, namely, when compression ratio is high, insufficient compression takes place. Insufficient compression means that the pressure in the compression chamber 11 at the time the compression chamber 11 communicates with the discharge port 22 is lower than the pressure P in the discharge space 21. Since pressure in the compression chamber 11 at the time of the compression chamber 11 communicates with the discharge port 22 is lower than the pressure P in the discharge space 21, the pressure p in the discharge port 22 drops sharply as shown by the broken line L3 in FIG. 7 while the compression chamber 11 communicates with the discharge port 22. Therefore, the pressure P in the discharge space 21 becomes higher than the pressure p in the discharge port 22 and thus, a force pushes the check valve 40 rearwardly. At this time, the check valve 40 is detached from the valve retainer 5. However, since compression is performed continuously, the pressure p in the discharge port 22 is recovered at once and thus, the check valve 40 is again depressed against the valve retainer 5. Noise or wear of the check valve 40 and the valve retainer 56 will be produced by the repetition of these conditions.

Since the area of close contact between the prior art check valve 4 and the valve retainer 5 is small, the prior art check valve 4 is readily detached from the valve retainer 5.

On the other hand, the check valve 40 of the present invention is held in close contact, over substantially the entire surface of the ring 44, with the valve retainer 5. Meanwhile, since refrigerant gas flowing in the vicinity of the check valve 40 contains generally 1 to 5% refrigerant oil for lubrication or sealing of the compression chamber, the refrigerant oil adheres also to the contacting portions of the check valve 40 and the valve retainer 5. Even if a force pushing the check valve 40 rearwardly is applied to the check valve 40 in this state, an oil film at the contacting portions of the check valve 40 and the valve retainer 5 prevents the check valve 40 from being readily detached from the valve retainer 5. Furthermore, since the pressure p in the discharge port 22 is recovered as described above, the check valve 40 is not detached from the valve retainer 5 so long as the check valve 40 is held in contact with the valve retainer 5 for only a minute period by the oil film present at the contacting portions of the check valve 40 and the valve retainer 5. Therefore, the chattering of and production of noise by the check valve 40 can be prevented during operation of the scroll compressor. Moreover, even if a violent counter-pressure prevailing at the site of the oil film is produced so as to detach the check valve 40 from the valve retainer 5 with consequent chattering of the check valve 40, wear of the check valve 40 and the tube 23 is not likely to take place in contrast with a case in which the thin distal end of each of the legs 45 of the prior art check valve 4 rubs against an inner wall of the tube 23.

In addition, in the prior art check valve 4 having the shape of a cross, since flow paths for refrigerant are defined by the legs 45 and the valve retainer 5, the flow paths vary according to position of the prior art check valve 4, thereby resulting in rotation of the prior art check valve 4.

On the other hand, since the flow paths 44 of the check valve 40 of the present invention are formed uniformly by blanking, the check valve 40 of the present invention is less likely to be rotated.

FIG. 6A shows forces applied to the check valve 40 during operation of the scroll compressor. Assuming that the pressure P in the discharge space 21 is applied to an area S of the check valve 40 and the pressure p in the discharge port 22 is applied to an area s of the check valve 40, the force W for pushing the check valve 40 rearwardly is given by the following equation.

$$W = P \times S - p \times s$$

During operation of the scroll compressor, the force W is usually less than zero, i.e., $W < 0$. However, during operation of the scroll compressor at a high compression ratio under a high load of a refrigeration cycle, the force W exceeds zero, i.e, $W > 0$ and thus, the check valve 40 is pushed rearwardly.

FIG. 8 shows a modification of the check valve device of FIG. 6A. Since the inside diameter d1 of the ring 42 of the check valve 40 is larger than the diameter D1 of the bore of the valve retainer 5 as shown in FIG. 8, the area S of the check valve 40, which is subjected to the pressure P in the discharge space 21, is reduced, so that the check valve 40 is less likely to be pushed rearwardly by the pressure P in the discharge space 21. Furthermore, since the ring 42 of the check valve 40 is disposed rearwardly of the valve retainer 5, the force of the refrigerant gas due to its back-flow is not applied to the ring 42 in a direction tending to cause the check valve 40 to detach from the valve retainer 5. Meanwhile, since gas is less likely to enter the oil film at the contacting portions of the check valve 40 and the valve retainer 5, the stability of the check valve 40 is ensured.

Figure 15:
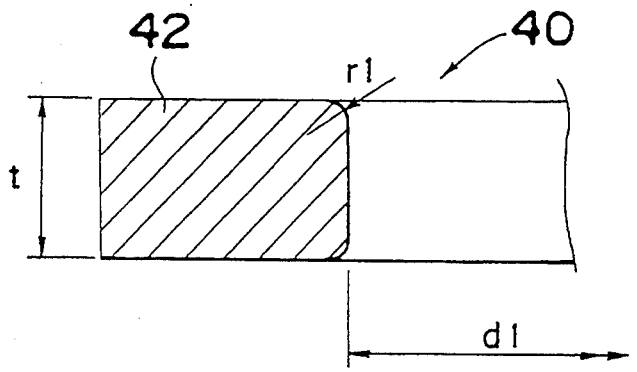
FIG. 15 is an enlarged fragmentary sectional view of the check valve of FIG. 2.
Figure 16:
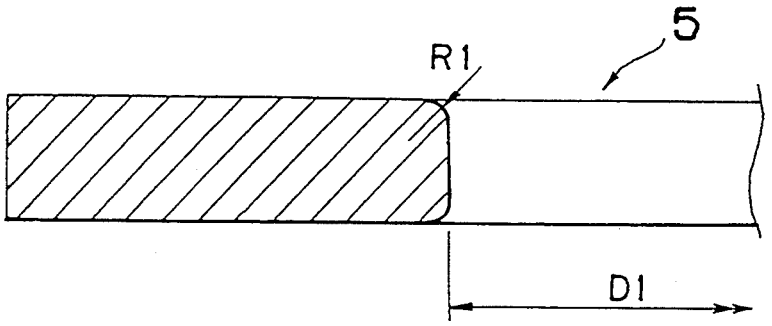
FIG. 16 is an enlarged fragmentary sectional view of the valve retainer of FIG. 5.

Generally, since the check valve 40 and the valve retainer 5 are produced by blanking or the like, corners of the check valve 40 and the valve retainer 5 become rounded. However, as the rounds become larger, effects of the present invention will be lessened. When corners of the check valve 40 and the valve retainer 5 are rounded, the effects of the present invention can be achieved by setting a radius r1 (FIG. 15) of corners of an inner periphery of the ring 42 of the check valve 40 and a radius R1 (FIG. 16) of corners of the bore of the valve retainer 5 as follows.

$$d1 + 2 \times r1 \geqq D1 + 2 \times R1$$

Meanwhile, if the radius r1 is smaller than the radius R1, i.e., $r1 < R1$, gas is less likely to enter the oil film present at the contacting portions of the check valve 40 and the valve retainer 5.

On the other hand, in order to smoothly displace the check valve 40 in the tube 23 vertically, a clearance $\delta$ should exist between the inside diameter D0 of the tube 23 and the outside diameter d0 of the ring 42, namely $\delta$ $(=D0-d0) > 0$. However, since an apparent maximum diameter of the check valve 40 is $(d0^2+t^2)^{0.5}$ due to the thickness t (FIG. 15) of the check valve 40, the clearance $\delta$ should be set as follows.

$$\delta = D0 - (d0^2 + t^2)^{0.5} > 0$$

Figure 12:
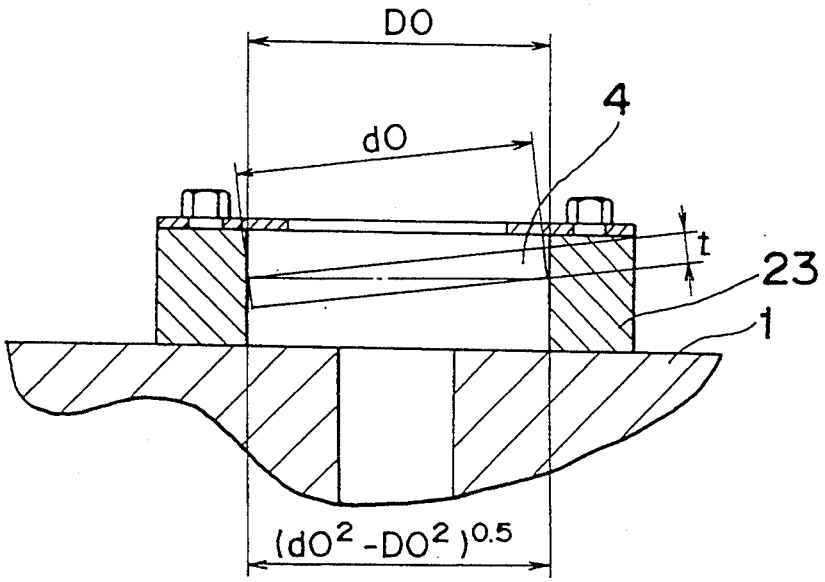
Fig. 12 PRIOR ART
FIG. 12 is a fragmentary longitudinal sectional view of the known check valve device of the compressor of FIG. 4.

By setting the relation $\{D0 > (d0^2+t^2)^{0.5}\}$, the check valve 40 does not cling to the tube 23 even if the check valve extends obliquely to the axis of the tube 23. FIG. 12 shows a prior art check valve device having the relation $\{D0 < (d0^2+t^2)^{0.5}\}$. As is clear from this relation, the apparent maximum diameter (diagonal) of the check valve 40 is larger than the inside diameter D0 of the tube 23. Therefore, when the check valve 40 is oriented obliquely to the axis of the tube 23, the check valve 40 strikes against the inner wall of the tube 23 as shown in FIG. 12, which prevents smooth vertical displacement of the check valve 40 in the tube 23.

In the check valve device of the present invention, a refrigerant oil film present at the contacting portions of the check valve 40 and the valve retainer 5 prevents the check valve 40 from being readily detached from the valve retainer 5 as described above the force exerted by the oil film is greatly influenced by the surface roughnesses of the check valve 40 and the valve retainer 5.

Figure 13A:
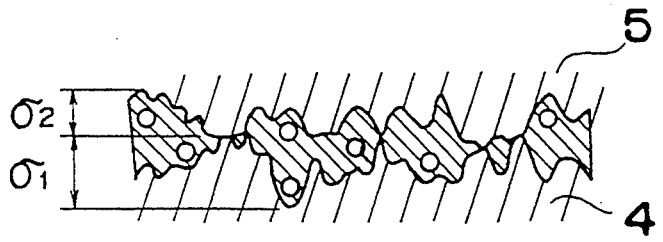
Fig. 13A PRIOR ART
FIGS. 13A and 13B each illustrate a relation between surface roughness of a check valve and a valve retainer and oil film in the known check valve device of FIG. 12 and the check valve device of FIG. 1, respectively.
Figure 13B:
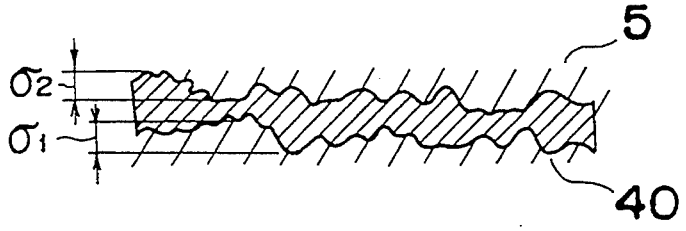

Hereinbelow, the influence of the surface roughnesses of the check valve 40 and the valve retainer 5 upon the effects of the oil film is described. FIG. 13A shows a relation between the surface roughnesses of the check valve 4 and the valve retainer 5 and the oil film in the prior art check valve device of FIG. 4, while FIG. 13B shows a relation between the surface roughnesses of the check valve 40 and the valve retainer 5 and the oil film in the check valve device of the present invention. When the surface roughnesses of the check valve 4 and the valve retainer 5 are great, the check valve 4 and the valve retainer 5 are brought into point contact with each other as shown in FIG. 13A. In this state, distances between portions of the check valve 4 and the valve retainer 5 are great and oil is less likely to fill the spaces between portions of the check valve 4 and the valve retainer 5. As a result, the force exerted by the oil film at the contacting portions of the check valve 4 and the valve retainer 5 is weak.

On the contrary, when the surface roughnesses of the check valve 40 and the valve retainer 5 are small, oil fills the gaps between portions of the check valve 40 and the valve retainer 5 as shown in FIG. 13B and thus, the force produced by the oil film present between the check valve 40 and the valve retainer 5 is sufficiently large.

Figure 14:
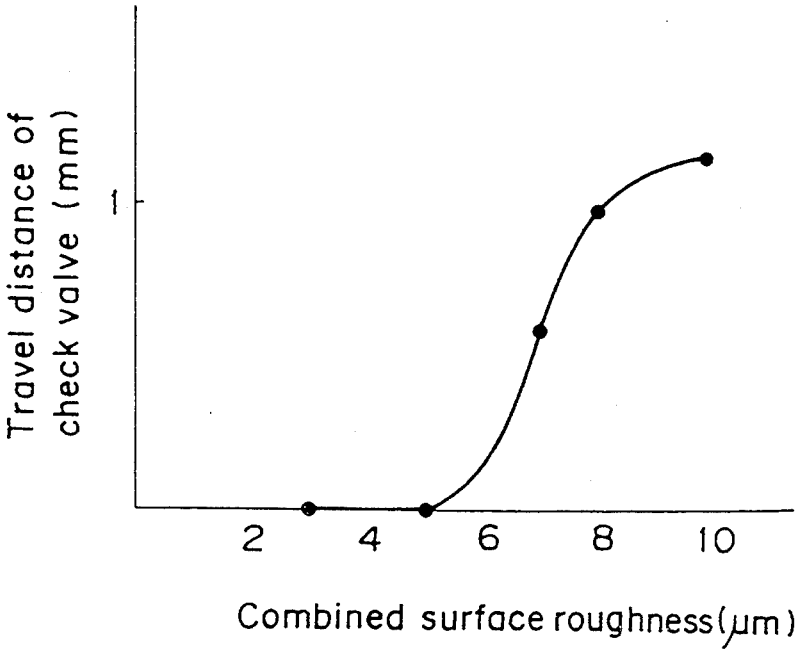
FIG. 14 is a graph showing a relation between combined surface roughness of the check valve and the valve retainer and distance over which the check valve travels in the check valve device of FIG. 1.

FIG. 14 shows results of experiments conducted to determine the relation between a combined surface roughness of the check valve device and a vertical distance over which the check valve 40 travels. Supposing that the check valve 40 has a surface roughness $\sigma 2$, the combined surface roughness $\sigma$ of the check valve device is obtained by the following equation.

$$\sigma=(\sigma 1^2+\sigma 2^2)^{0.5}$$

In FIG. 14, the abscissa represents the combined surface roughness $\sigma$ of the check valve device, while the ordinate represents the distance of vertical travel (chattering) of the check valve 40 under high-load operational conditions. When the combined surface roughness $\sigma$ of the check valve 40 and the valve retainer 5 is 5 $\mu$m or more, vertical displacement (chattering) of the check valve 40 is produced and thus, the noise level also rises. This is due to a weak force produced by the oil film between the check valve 40 and the valve retainer 5. In the present invention, the combined surface roughness of the check valve 40 and the valve retainer 5 is set to be smaller than a thickness $\epsilon$ of 5 $\mu$m of the oil film such that vertical displacement of the check valve 40 is restrained by the viscosity of the refrigerant oil. As a result, chattering of the check valve 40 is prevented over a wide operational range so that noise of the scroll compressor is minimized and other undesirable conditions, such as wear, etc., are eliminated.

In the present invention, the check valve 40 has the ring 42 at its outer periphery. However, even if the check valve 40 were to have a starlike shape, the oil film can produce a sufficient force between the check valve 40 and the valve retainer 5 by upgrading the surface roughnesses of the check valve 40 and the valve retainer 5. Although polishing is generally employed for obtaining the surface roughness required in the present invention, other working processes may be used instead.

Further, although the tube 23 is mounted on an upper face of the fixed scroll 1 in the present invention, the tube 23 may be defined by a bore formed in the fixed scroll 1.

(1) As is clear from the foregoing description, the check valve device of the present invention comprises: the check valve 40 which includes the disk 41 for closing the discharge port 22, the ring 42 concentric with the disk 41 and a plurality of the beams 43 for coupling the disk 41 and the ring 42; the tube 23 for receiving the check valve 40, which is provided at the discharge port 22 of the fixed scroll 1; and the valve retainer 5 for retaining the check valve 40, which is provided at the outlet portion of the tube 23 so as to confront the ring 42 of the check valve 40. Since the ring 42 of the check valve 40 and the valve retainer 5 are brought into close contact with each other, the check valve device is operated stably against the flow of the refrigerant, so that the check valve 40 will not produce noise over a wide operational range, i.e., chattering of the check valve 40 will be suppressed. Furthermore, even if chattering of the check valve 40 occurs, wear of the ring 42 and the tube 23 can be restrained. Accordingly, a highly reliable and low-noise scroll compressor can be realized.

(2) The inside diameter d1 of the ring 42 of the check valve 40, the diameter D1 of the bore of the valve retainer 5, the radius r1 of the corners of the inner periphery of the ring 42 and the radius R1 of the corners of the bore of the valve retainer 5 are set as follows.

$$d1>D1$$

$$r1<R1$$

$$(d1+2\times r1)\geqq(D1+2\times R1)$$

Furthermore, the thickness 5 of the check valve 40, the outside diameter d0 of the ring 42 and the inside diameter D0 of the tube 23 are set as follows.

$$D0>(d0^2+t^2)^{0.5}$$

Due to these features of the check valve device, stability of the check valve device is further improved.

(3) Furthermore, by establishing relation $\{D0>(d0^2+t^2)^{0.5}\}$, the check valve 40 can be smoothly displaced in the tube 23.

(4) Moreover, when the check valve 40 has a surface roughness $\sigma 1$ and the valve retainer 5 has a surface roughness $\sigma 2$, the combined surface roughness a of the check valve device is defined as follows.

$$\sigma=(\sigma 1^2+\sigma 2^2)^{0.5}$$

When the oil film formed between the check valve 40 and the valve retainer 5 has the thickness $\epsilon$, the following relation is set.

$$\sigma<\epsilon$$

Due to this feature of the check valve device, the force produced by the oil film present between the check valve 40 and the valve retainer 5 will be sufficiently large, so that a highly reliable and low-noise scroll compressor functioning stably over a wide operational range is realized.

What is claimed is:

1. In a scroll compressor in which a crescent-shaped compression chamber is defined by a fixed scroll and an orbiting scroll and the orbiting scroll is driven through an eccentric bearing by a driving shaft so as to compress gas introduced into the compression chamber such that the compressed gas is discharged into a discharge space out of a discharge port provided in the vicinity of a center of the fixed scroll, a check valve device comprising:

a check valve including a circular disk for closing the discharge port, a circular ring concentric with the disk, and a plurality of beams coupling the disk and the ring, each of said beams having opposite sides, said beams being spaced apart from each other in the circumferential direction of the disk by distances respectively greater than the widths of each of said beams as taken between the opposite sides thereof such that a plurality of flow paths are defined between said disk and said ring, each of said flow paths being delimited by an arcuate inner peripheral surface of said ring, an arcuate outer peripheral surface of said disk, and respective sides of adjacent ones of said beams;

a tube receiving the check valve, and provided at the discharge port of the fixed scroll; and a valve retainer for retaining the check valve, said valve retainer being provided at an outlet portion of the tube and confronting the ring of the check valve, and said valve retainer having a bore that communicates with said flow paths when the check valve is retained by said valve retainer.

2. A check valve device in a scroll compressor as claimed in claim 1, and satisfying the following relation (1):

$$d1 \geqq D1 \quad (1)$$

wherein:

"d1" denotes an inside diameter of the ring of the check valve, and

"D1" denotes a diameter of the bore of the valve retainer.

3. A check valve device in a scroll compressor as claimed in claim 1, and satisfying the following relations (2) and (3):

$$r1 < R1 \quad (2)$$

and $$(d1+2\times r1) \geqq (D1+2\times R1) \quad (3)$$

wherein:

"d1" denotes an inside diameter of the ring of the check valve,

"D1" denotes a diameter of the bore of the valve retainer,

"r1" denotes a radius of corners of the inner peripheral portion of the ring of the check valve, and "R1" denotes a radius of corners of an inner peripheral portion of the valve retainer defining the bore of the valve retainer.

4. A check valve device in a scroll compressor as claimed in claim 1, and satisfying the following relation (4):

$$D0 > (d0^2+t^2)^{0.5} \quad (4)$$

wherein:

"D0" denotes an inside diameter of the tube,

"d0" denotes an outside diameter of the ring of the check valve, and

"t" denotes a thickness of the check valve.

5. In a scroll compressor in which a crescent-shaped compression chamber is defined by a fixed scroll and an orbiting scroll and the orbiting scroll is driven through an eccentric bearing by a driving shaft so as to compress gas introduced into the compression chamber such that the compressed gas is discharged into a discharge space out of a discharge port provided in the vicinity of a center of the fixed scroll, a check valve device comprising:

a check valve confronting the discharge port and movable towards and away from the fixed scroll; and a valve retainer into which the check valve is movable;

wherein when surfaces of the check valve and the valve retainer are brought into contact with each other and have surface roughnesses of $\sigma 1$ and $\sigma 2$, respectively, a combined surface roughness of $\sigma$ of the check valve device is defined by the following equation (5):

$$\sigma = (\sigma 1^2 + \sigma 2^2)^{0.5} \quad (5),$$

and wherein an oil film formed between the surfaces of the check valve and the valve retainer satisfies the following relation (6):

$$\sigma < \epsilon \quad (6)$$

"$\epsilon$" denoting a thickness of the oil film.

6. A check valve device in a scroll compressor as claimed in claim 5, wherein said combined surface roughness $\sigma$ is less than 5 $\mu$m.

7. A check valve device in a scroll compressor as claimed in claim 5, and further comprising a tube at the discharge port of the fixed scroll, and wherein the check valve includes a disk for closing the discharge port, a ring concentric with the disk, and a plurality of beams coupling the disk and the ring, wherein the valve retainer is disposed at an outlet portion of said tube and confronts the ring of the check valve, and wherein the ring of the check valve has said surface roughness $\sigma 1$.

8. A check valve device in a scroll compressor as claimed in claim 7, wherein said check valve has a plurality of flow paths therethrough, wherein said valve retainer has a bore that communicates with said flow paths when the check valve has moved into contact with said valve retainer, and wherein the following relation (1) is satisfied:

$$d1 \geqq D1 \quad (1)$$

wherein

"d1" denotes an inside diameter of the ring of the check valve, and

"D1" denotes a diameter of the bore of the valve retainer.

9. A check valve device in a scroll compressor as claimed in claim 7, wherein said check valve has a plurality of flow paths therethrough, wherein said valve retainer has a bore that communicates with said flow paths when the check valve has moved into contact with said valve retainer, and wherein the following relations (2) and (3) are satisfied:

$$r1 < R1 \quad (2),$$

and $$(d1+2\times r1)\geqq(D1+2\ R1) \quad (3)$$

wherein:

"d1" denotes an inside diameter of the ring of the check valve,

"D1" denotes a diameter of the bore of the valve retainer,

"r1" denotes a radius of corners of the inner peripheral portion of the ring of the check valve, and "R1" denotes a radius of corners of an inner peripheral portion of the valve retainer defining the bore of the valve retainer.

* * * * *